United States Patent [19]

Begle et al.

[11] Patent Number: 4,979,594

[45] Date of Patent: Dec. 25, 1990

[54] METHOD AND EQUIPMENT FOR THE SECURE AND CONVENIENT INPUT OF CONTROL COMMANDS, IN PARTICULAR IN LIFT INSTALLATIONS

[75] Inventors: Guntram Begle, Adligenswil; Thomas Hinderling, Ebikon, both of Switzerland

[73] Assignee: Inventio AG, Hergiswil, Switzerland

[21] Appl. No.: 347,299

[22] Filed: May 4, 1989

[30] Foreign Application Priority Data

May 11, 1988 [CH] Switzerland ..... 01803/88

[51] Int. Cl.[5] ..... B66B 1/46

[52] U.S. Cl. ..... 187/121

[58] Field of Search ..... 187/100, 101, 121, 124, 187/130

[56] References Cited

U.S. PATENT DOCUMENTS

| | | | |
|---|---|---|---|
| 4,655,324 | 4/1987 | Meguerdichian et al. | 187/121 |
| 4,673,911 | 6/1987 | Yoshida | 187/100 |
| 4,685,538 | 8/1987 | Kamaike | 187/121 |

FOREIGN PATENT DOCUMENTS

| | | |
|---|---|---|
| 3330345 | 3/1985 | Fed. Rep. of Germany . |
| 3631179 | 3/1987 | Fed. Rep. of Germany . |

*Primary Examiner*—A. D. Pellinen
*Assistant Examiner*—W. E. Duncanson, Jr.
*Attorney, Agent, or Firm*—Sandler, Greenblum & Bernstein

[57] ABSTRACT

In this wireless remote control system, control signals and reporting-back signals are bidirectionally transmited between at least one portable transmitter-receiver unit, a stationary transmitter-receiver unit and a control. The portable transmitter-receiver unit contains a microprocessor and is carried, for example, by hand or in a clothing pocket. Control commands are input, depending upon their frequency of occurrence, by way of a ten-key keyboard, fixed keys or stored in a storage and transmitted as control signals via an operating mode selector switch selectively in either one of the operating modes "manually by push-button" or "automatically, permanently". The signalling is non-public and on an indicator. The stationary transmitter-receiver unit with microprocessor is mounted stationarily in the transmission range of the associated portable transmitter-receiver unit and communicates the received control commands to the control. This remote control permits location-independent input of public and non-public operating requests into elevator installations and thereby a conveniently and secure call issue to protected storys. The method and the equipment can likewise be used for operating doors, escalators, turnstile and so forth and thus are generally suitable for controlling access and facilitating personnel traffic in buildings.

7 Claims, 2 Drawing Sheets

METHOD AND EQUIPMENT FOR THE SECURE AND CONVENIENT INPUT OF CONTROL COMMANDS, IN PARTICULAR IN LIFT INSTALLATIONS

BACKGROUND OF THE INVENTION

The present invention relates to a new and improved method and new and improved construction of equipment for securely and conveniently inputting of control commands, particularly into elevator installations.

In its more particular aspects, the present invention specifically relates to a new and improved method and construction of equipment for securely and conveniently inputting control commands, particularly into elevator installations. Therein, control commands are input at a portable wireless transmitter and transmitted thereby as encoded control signals which are received by a stationary receiver. After decoding, the signals are supplied to a control. The recordial and execution of these control commands at the control end is signalled.

Such method is intended to permit inputting control commands into a control without using location-bound command transmitters. Calls to secure or protected storys or floors as well as normal calls without the use of story or cabin call keys thus can be input into elevator installations independent of the location from the closer neighborhood of an elevator.

During conventional operation of a control, the input of the control commands is often bound to mechanical command transmitters and thus dependent on their location. This can impair the operating convenience and renders more difficult using the control for security purposes. An input of the control commands, which is independent of location and gives freedom of movement, for example, by means of wireless remote control, is therefore desirable in many cases.

In a method and equipment for private or solely authorized operation of an elevator such as known, for example, from U.S. Pat. No. 4,655,324, granted Apr. 7, 1987 and the cognate German Published patent application No. 3,631,179, published Mar. 26, 1987, a wireless transmitter, a receiver as well as a cabin control installation are provided and interact in the afore-described manner. A passenger inputs a cabin call or another cabin request by actuating a (manually) portable, wireless concealable transmitter having one or more keys which designate a respective story or floor and can be used in combination in order to obtain access to a secure story or floor or to instruct other functions like, for example, emergency stops or silent emergency calls. The passenger carries the remote control transmitter, for example, in a clothing pocket, and inputs a call, for example, for normal purposes, for security purposes or any other function by actuating the respective keys. A receiving aerial or sensor is provided in the cabin and receives the transmitted command which, in turn, is transmitted to the cabin control much in the same manner as if directly input at the cabin keys. Depending on the inputted command the cabin control can light up a button at the cabin operating panel and thus acknowledge the inputted command in accordance with the mode of operation corresponding to the inputted command.

One disadvantage of this method results from the circumstance that the portable transmitter acts unidirectionally on the stationary receiver and, accordingly, no connection exists in the reverse direction. Therefore, signal transmission from the control to the portable transmitter is impossible, in order to privately acknowledge the recordal of a call by indication on the portable transmitter, for example, in elevator installations. Consequently, the acknowledgement of calls must be effected at the cabin panel and thus in a public manner and one which is visible to everybody, whereby a secure elevator operation may be impaired.

It has also proved to be disadvantageous that there is no possibility of storing more frequently used control commands in the portable transmitter in order that they can be directly transmitted, if desired, by means of, for example, fixed keys. Control commands must thus be input particularly when the same control command must be used several times per day.

It is a further disadvantage that no automatic system is provided for privately operating the elevator in the method according to the afore-mentioned U.S. Pat. No. 4,655,324. In fact, each control command must be individually and manually inputted at the portable transmitter whereupon the control command is transmitted either immediately or after a preset time delay. Particularly in hotel elevators however, it can be advantageous if the control commands are automatically and permanently transmitted so that a hotel guest can reach his story or floor and room without manipulation and according to any desired time schedule. The manual as well as the automatic but temporally fixed command input reduce the operating convenience, since they force the hotel guest to put down and again pick up his luggage or to move according to a predetermined time schedule.

A still further basic deficiency must be seen in that the aforementioned known method does not permit programming and its operating parameters and characteristic magnitudes thus cannot be easily and rapidly varied. Such method, therefore, has very little flexibility and is poorly adapted to security-technical use if a security arrangement like, for example, the locking or closing schedule of a building must be altered at irregular time intervals for security-technical considerations. Here, the invention intends to provide a remedy.

SUMMARY OF THE INVENTION

Therefore with the foregoing in mind it is a primary object of the present invention to provide a new and improved method and a new and improved construction of equipment for the secure and convenient input of control commands, particularly in elevator installations and which method and equipment are not afflicted with the aforementioned drawbacks and shortcomings of the prior art methods and constructions.

Another and more specific object of the present invention is directed to the provision of a new and improved method and a new and improved construction of equipment for the secure and convenient input of control commands, particularly in elevator installations, and which method and equipment ca be used with the same advantages in other technical installations, buildings, plants and the like in order to enable independent and individual, non-public control and, at the same time, controlling the access as well as the personnel traffic in such installations.

A further significant object of the present invention is directed to a new and improved method and a new and improved construction of equipment for the secure and convenient input of control commands, particularly in elevator installations, and which method and equipment have operating parameters and characteristic magnitudes which can be readily and rapidly changed in order to either permit adaptation to different security arrangements or changes at irregular time intervals in order to maintain security.

Yet a further important object of the present invention aims at providing a new and improved method and a new and improved construction of equipment for the secure and convenient input of control commands, particularly in elevator installations, and which method and equipment are highly reliable in operation, not readily subject to malfunction and require a minimum of maintenance and servicing.

Now in order to implement these and still further objects of the invention, which will become more readily apparent as the description proceeds, the method of the present development is manifested, among other things, by the features that, the control commands are allocated, depending upon their frequency of occurrence, to either one of the three following groups:

(i) Rarely occurring control commands;

(ii) More frequently occurring control commands; and (iii) Very frequently occurring control commands.

Rarely or more frequently occurring control commands are respectively and individually inputted by means of a ten-key keyboard or fixed keys using at least one portable transmitter-receiver unit. Very frequently occurring control commands are permanently stored in the portable transmitter-receiver unit. The inputted or permanently stored control commands are converted in the portable transmitter-receiver unit into control signals comprising a security-related signal component and a function-related signal component. Such control signals are selectively transmitted in either one of the operational modes "manual, by push-button" and "automatically, continuously". After transmitting a control signal, the portable transmitter-receiver unit is automatically switched to the receiving mode for a constant period of time.

The control signal transmitted by the at least one transmitter-receiver unit is received by at least one stationary transmitter-receiver unit and subjected therein to a security analysis as well as a function analysis. In the event of a negative result of the security analysis, the received control command is ignored by the stationary transmitter-receiver unit. In the event of a positive result of the security analysis, the received control command is inputted into a control and a first response or reply signal is transmitted by the stationary transmitter-receiver unit. The recordal of the control command is signalled by the indicator of the at least one portable transmitter-receiver control command.

After executing the control command, the stationary transmitter-receiver unit transmits a second response or reply signal which extinguishes or erases the indication at the at least one portable transmitter-receiver unit and thereby makes the same available for inputting the next-following control command.

As alluded to above, the invention is not only concerned with the aforementioned method aspects, but also relates to a novel construction of equipment for carrying out the same. Generally speaking, the inventive equipment for the secure and convenient input of control commands, particularly in elevator installations, comprises a portable wireless transmitter-receiver unit into which the control commands are inputted and which transmits the inputted control commands in the form of encoded control signals. The equipment further comprises a stationary transmitter-receiver unit which receives the encoded control signals and supplies the same, after decoding, to control means. The stationary transmitter-receiver unit signals the recordal as well as the execution of the control commands.

To achieve the aforementioned measures, the inventive equipment in its more specific aspects, comprises:

In the at least one portable wireless transmitter-receiver unit for transmitting the control signals and receiving response or reply signals, a microprocessor, a ten-key keyboard as well as fixed keys for respectively inputting rarely occurring control commands and more frequently occurring control commands, storage means for permanently storing very frequently occurring control commands, a wireless transmitter containing an operation mode selector switch for respectively transmitting the control signals in the operational modes "automatic, continuous" and "manual by push-button" either automatically or by means of a transmitter key, a receiver and an indicator for signalling;

in the stationary transmitter-receiver unit, a receiver, a microprocessor for receiving the control signals as well as analyzing the control signals with respect to security and for passing the control signals on to control means, and a transmitter for transmitting response or reply signals signalling the status of the control means; and control means for executing the control commands received from the at least one stationary transmitter-receiver unit and for generating the response or reply signals defining the control status.

Furthermore, the inventive method and equipment have various advantages. It is one such advantage that the method according to the invention is in no way restricted to controlling the operation just of doors and elevators. Actually and, if desired, at the same time the method can also be utilized for controlling also other access-governing installations such as escalators, turnstiles and the like. An access control of this type or structure thus can be designed in a simple manner at any desired redundancy and thereby to be as secure as desired.

Additional advantages result from the circumstance that the invention permits rapid and early issue of a command. This leads to shortened waiting times in elevator installations and thereby to a increase in the carrying capacity and a general easing of traffic. It is further noted that the microprocessor-aided method renders possible individually detecting and monitoring the private, i.e. non-public personnel traffic and thereby renders more secure every access check or control. Preferably, the access-authorized personnel traffic is individually detected and analyzed with respect to access location, access time, access duration and other traffic parameters and a comprehensive picture of security events is continuously obtained therefrom.

Furthermore, it has been found to be advantageous that the inventive method is programmable and thereby very flexible in use. Changes in the access authorization in respect of persons, buildings, access times and so forth thus can be rapidly programmed at any desired time. It has also been found that the equipment for carrying out the inventive method can be installed at any desired location and integrated into existing control systems, for example, by means of a data-collection bus.

Accordingly, the inventive method and equipment are superbly suitable for retrofitting conventional controls or control systems for wireless remote operation whereby such controls or control systems are restructured regarding security in their manner of operation and conveniency of operation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
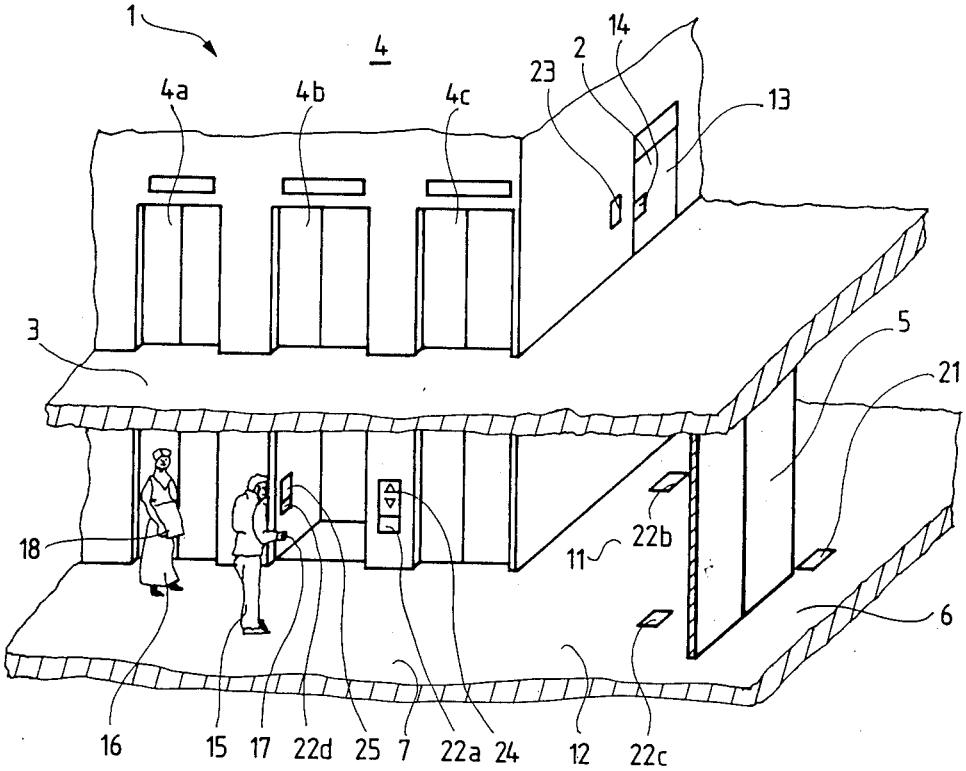
FIG. 1 is a perspective view showing the disposition and basic structure of an installation for using an exemplary embodiment of the inventive method for checking or controlling the access to a security area and facilitating personnel traffic in such security area.

Describing now the drawings, it is to be understood that to simplify the showing thereof, only enough of the equipment for the secure and convenient input of control commands has been illustrated therein as is needed to enable one skilled in the art to readily understand the underlying principles and concepts of the invention. Turning now specifically to FIG. 1 of the drawings, the elevator installation illustrated therein by way of example and not limitation will be seen to comprise a security area 1 which is constructed as part of a larger building. Such security area 1, in the illustrated example, contains a security door 5 in the main entrance 6, an elevator group 4 containing elevators 4*a*, 4*b* and 4*c*, a security laboratory 2 as well as additional, not specifically illustrated premises in higher storys or floors. The elevator group 4 leads from a lobby 7 containing accesses 11 and 12 into the upper storys or floors and from a first story or floor 3 further to the security laboratory by way of a laboratory door 13 with a laboratory door lock 14.

Two users 15 and 16 of the method according to the invention are present in the lobby 7. The users 15 and 16 are shown at the moment of boarding the central elevator 4*b*. Each user 15 and 16 carries a respective portable transmitter-receiver unit 17 and 18 for controlling the secure and/or convenient operation of the security door 5, the elevator group 4, the laboratory door 13 or further not illustrated technical installations operable by such control. For this purpose, at least one stationary transmitter-receiver unit, which cooperates with the portable transmitter-receiver units 17 and 18, is associated with each of the aforenoted technical installations to be operated, namely the stationary transmitter-receiver unit 21 associated with the security door 5, the stationary transmitter-receiver units 22*a*, 22*b*, 22*c* and 22*d* associated with the elevator group 4 and the stationary transmitter-receiver unit 23 associated with the laboratory door 13.

Figure 2:
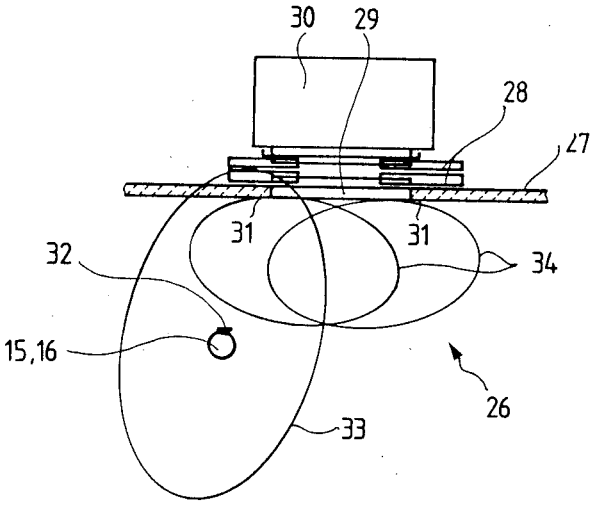
FIG. 2 is a schematic illustration showing an elevator stop in an exemplary embodiment of the inventive equipment containing a possible arrangement of portable and stationary transmitter-receiver units for inputting control commands or operating demands at a story or floor of an elevator installation.

In the specific example illustrated in FIG. 2, the inventive equipment and its basic manner of operation for carrying out the inventive method, is shown in combination with a stop or stopping location 26 of the elevator group 4, where operating requests originating from the associated story or floor can be inputted as control commands into the elevator group control. In the building wall 27 next to the elevator doors 28, respective stationary transmitter-receiver units 31 are disposed on the left and on the right of the entrance 29 to the cabin 30. Portable transmitter-receiver units 32 are respectively carried by the users 15 and 16. The transmitting and receiving ranges of the individual transmitter-receiver units 31 and 32 are represented by ellipses 33 and 34. Analogous device configurations, however, with only one respective stationary transmitter-receiver unit 21 and 23, are provided also for inputting the control commands controlling the security door 5 and the laboratory door 13. Of course, approximately the same operative ranges corresponding to the ellipses 33 and 34 are effective at these stationary transmitter-receiver units 21 and 23.

For reasons which will be explained further hereinbelow and predominantly concern the operating convenience, not just one, but four spatially distributed stationary transmitter-receiver units 22*a*, 22*b*, 22*c* and 22*d* are associated with the elevator group 4, as shown in the schematic functional block diagram of FIG. 3. Each portable transmitter-receiver unit 17 and 18 is in bidirectional wireless communication with each one of the stationary transmitter-receiver units 21, 22*a*, 22*b*, 22*c*, 22*d* and 23 within the scope of the association of their effective ranges as determined by their mutual local positions relative to each other and as illustrated by the ellipses 33 and 34 in FIG. 2. The stationary transmitter-receiver units 21, 22*a*, 22*b*, 22*c*, 22*d* and 23, respectively transmit received control signals ($SS_l$. . . $SS_n$) to a control 40 of a drive 41 acting upon the security door lock 42, a control 43 of drives 44 associated with the elevator group 4, or a control 45 of a drive 46 acting upon a laboratory door lock 47 and receive for signalling purposes the corresponding response or reply signals $RM_l$. . . $RM_n$ in reverse direction for further transmission to the portable transmitter-receiver units 17 and 18.

Figure 3:
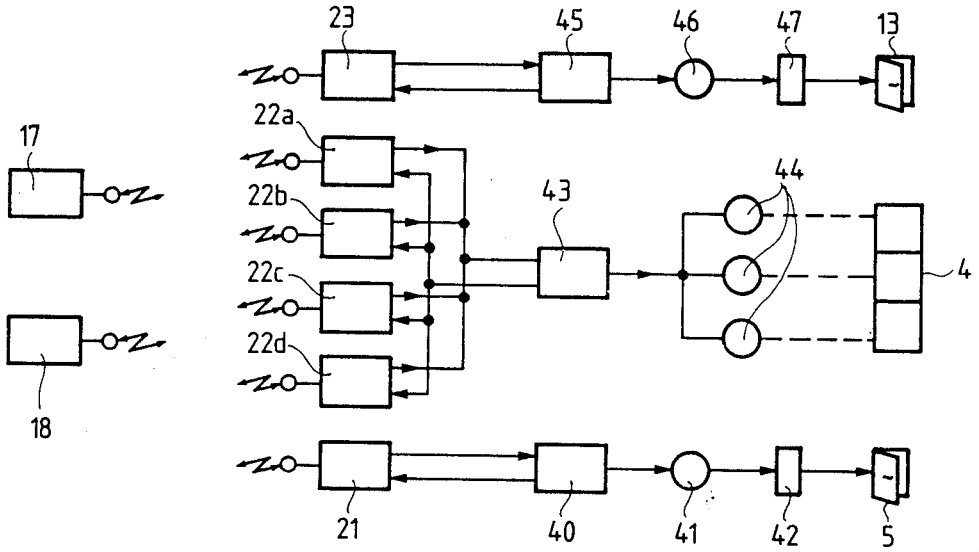
FIG. 3 is a schematic functional block diagram of the inventive equipment for carrying out the exemplary embodiment of the inventive method shown in FIG. 1.
Figure 4:
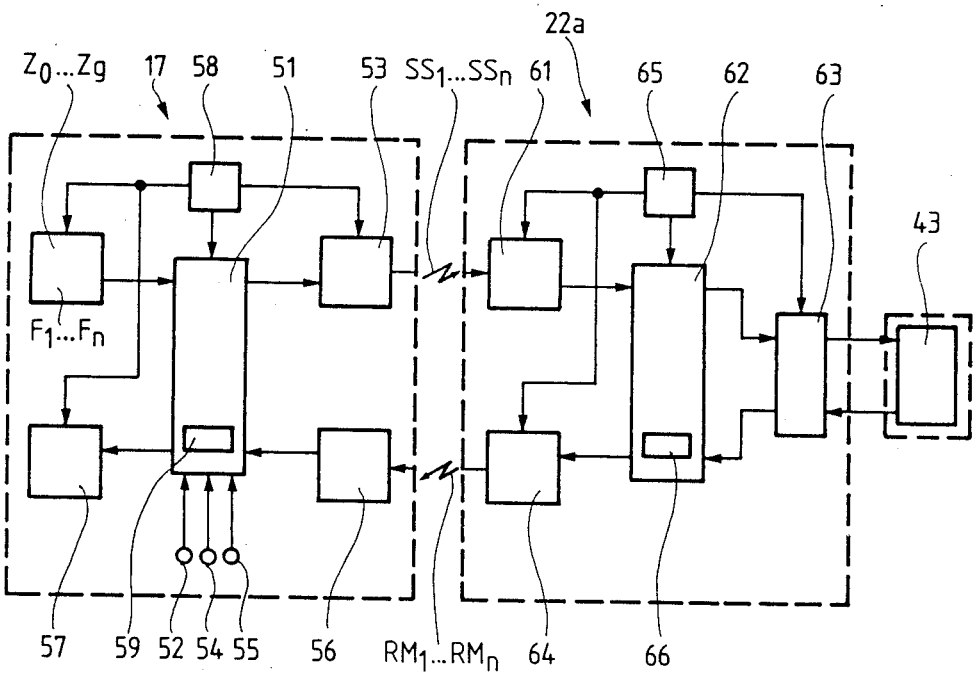
FIG. 4 is a more detailed functional block circuit diagram of the portable and stationary transmitter-receiver units shown in FIG. 2.

The functional structure of the aforementioned portable and stationary transmitter-receiver units is shown in FIG. 4 by way of example with respect to the input of control commands at the elevator group 4 as shown in FIGS. 1 and 3. As illustrated, control commands $SS_l$. . . $SS_n$ originating from the portable transmitter-receiver unit 17 are transmitted via the stationary transmitter-receiver unit 22*a* to the elevator group control 43 and signals $RM_l$. . . $RM_n$ are transmitted in the reverse direction. Depending upon their frequency of occurrence, the control commands are made available at the portable transmitter-receiver unit 17 in different manners. Rarely occurring control commands, referred to simply sometimes as commands SSB as well as more frequently occurring control commands, referred to simply sometimes as commands öSB are respectively inputted by means of a ten-key keyboard $Z_0$. . . $Z_9$ or fixed keys $F_1$ . . . $F_n$ at the portable transmitter-receiver unit 17. Conversely, very frequently occurring control commands, referred to sometimes as commands OSB are permanently stored in a storage or storage means 59 of a microprocessor 51.

The allocation of a more frequently occurring control command öSB to a fixed key $F_1 \ldots F_n$ is effected by operating the selected fixed key simultaneously with a memory key 52. The inputted as well as the permanently stored control commands SSB, oSB and OSB are subject to a conversion, which constitutes a step of the inventive method and will be explained further hereinafter, in the microprocessor 51 into control signals $SS_l \ldots SS_n$, which are transmitted by a transmitter 53 in both the aforementioned operating modes "automatically, continuously" and "manually by push-button" in accordance with the setting of the operating mode selector switch 54. The transmitter 53 serves for the communicating data and operates in an approved frequency band which does not cause any interference with radio, television or data transmission channels.

The response or reply signals $RM_l \ldots RM_n$ transmitted by the stationary transmitter-receiver unit 22a arrive at the microprocessor 51 via a receiver 56 in order to be supplied from there, after appropriate conversion, to the indicator 57 for display. The indication or display serves to indicate the state or condition of the portable transmitter-receiver unit 17. As long as no response is recorded to the transmitted control signal, the indication or display remains dark. When a response signal is recognized by the receiver 56, an acknowledgement is effected and the indicator 57 is switched on. The indicator 57 is switched off when all functions or requested operations have been carried out. The indicator 57 is actuated by means of the microprocessor 51. Normally, a built-in button or round cell serves as power supply 58 for the portable transmitter-receiver unit 17. When this unit 17 is carried openly, an integrated solar cell contributes to supplying power to the electronic system.

In the stationary transmitter-receiver unit 22a, a receiver 61 passes the received control signals $SS_l \ldots SS_n$ to a microprocessor 62 where the received control signals are evaluated in accordance with a further step of the inventive method and supplied to the elevator group control 43 by means of an interface 63 which is constructed as a serial bus. In the reverse direction, signals originating from the elevator group control 43 are fed to the microprocessor 62, where they are converted in order to leave the stationary transmitter-receiver unit 22a via a transmitter 64 as response or reply signals $RM_l \ldots RM_n$. The stationary transmitter-receiver unit 22a, like all the other units of this type, is supplied with current by means of an individual power supply 65.

For explaining the manner of operation of the inventive method, reference is made to FIGS. 1 to 4 and explanation starts from the method steps which form the basis of the invention. The inventive method will be discussed with respect to both its main fields of use, namely for securely inputting of control commands and for improving the operating convenience. The first field of use is concerned with an access check or control in which the access to the non-public security laboratory 2 is secured with dual redundancy for the user 16, namely by means of the security door 5, the elevator group 4 as well as the laboratory door 13. In the second field of use, the user 15 has free access to all places so that such use has no security-related aspects for the user 15 but importantly serves for improving the operating convenience for the user 15.

In the first field of use concerned with security-related aspects, i.e. the access check or control to the security laboratory 2, the user 16 must arrive from the main entrance 6 at the lobby 7 of the security area 1 and therefore the security door 5 must be operated. Since this function is used daily, the related control command constitutes a more frequently occurring control command öSB which is expediently fixedly allocated to the fixed key $F_1$. When the user 16 is present at the main entrance 7, the user 16 inputs the control command for opening the security door 5 into his portable transmitter-receiver unit 18 by means of this fixed key $F_1$. The respective control is then transmitted, for example in the operating mode "manually by push-button", by operating the transmitting key 55. The corresponding stationary transmitter-receiver unit 21 receives the emitted control signal and, in the case of a positive security analysis, which will be explained in greater detail further hereinbelow with reference to the elevator group 4, releases the security door 5 for opening. When the user 16 has reached the lobby 7, he or she sends a story or floor call to the stationary transmitter-receiver unit 22a by means of the concealable, wireless, portable transmitter-receiver unit 18. The user 16 carries such portable transmitter-receiver unit 18 by hand or in a clothing pocket. The story or floor call can be inputted, for example, by using the fixed key F2 and is transmitted by actuating the transmitting key 55.

As shown in FIG. 4, the portable transmitter-receiver unit 18 possesses the operating mode selector switch 54 which permits switching-over between the two operating modes "automatically, continuously" and "manually by push-button":

In the setting "manually by push-button", the control signal $SS_l \ldots SS_n$ which is sent out upon actuation of the transmitting key 55 by the transmitter 53, has the following content: a security code or portion for identifying the user and a functional code operation. This security code or portion comprises two parts, namely building-related part (high byte) and a user-related part (low byte). The building-related part permits identification of individual buildings or building parts. The user-related part contains data of the user.

The functional code or portion concerns the control and also contains data related to a standard function or a special function. In the operational mode setting "automatically, continuously", the same data are automatically transmitted by the transmitter 53 at 200 millisecond intervals. Stories or floors which are only rarely served by the elevator, can be selected by means of the ten-key or decade keyboard $Z_0 \ldots Z_g$. For this purpose, the operating mode selector switch 54 is first to be set to the position "manually by push-button" and the desired story or floor is then keyed in. The data, i.e. the control signal is transmitted upon actuation of the transmitting key 55. Stories or floors which are served more frequently and do not constitute standard stories or floors, can be selected by operating the fixed keys $F_1 \ldots F_n$.Such stories or floors are stored by way of the combination with the memory key 52. Standard stories or floors are the main stop or entrance, the user's residence door or the story or floor at which the user's residence or office is located.

After each transmission of the control signal $SS_1 \ldots SS_n$, the microprocessor 51 switches over to reception for a brief period of time. When response or reply signals $RM_1 \ldots RM_n$ are received during this time period, these are filtered and thereafter communicated to the microprocessor 51 for identification and analysis. In detail, the microprocessor 51 is intended for carrying out the following functions: keyboard handling, recognition of the setting of the operating mode selector switch 54, storage and recognition of data coming from the keyboard, processing of the data to be transmitted, periodic or repeated data transmission, switching-over from transmitting to receiving operation, analysis of the received signals and controlling the indicating mode.

The stationary transmitter-receiver unit 22*a* receives the transmitted control signal $SS_1 \ldots SS_n$ and passes the story or floor call on to the elevator group control 43 call had been directly inputted at the story or floor panel 24. It is, of course, a precondition that the portable transmitter-receiver unit 18 is located within the receiving range of the stationary transmitter-receiver unit 22*a*.

The transmitter 64 at the stationary transmitter-receiver unit 22*a* serves for communicating the response or reply signals $RM_1 \ldots RM_n$. This transmitter 64 like the transmitter 53 in the portable transmitter-receiver units 17 and 18, operates in an approved frequency band which produces no interference in radio, television or data transmission channels.

The stationary transmitter-receiver unit 22*a* is normally switched into a reception mode. When control signals $SS_1 \ldots SS_n$ are received, such control signals are appropriately processed and thereafter fed to a microprocessor 62. When the received data are associated with the respective installation, the response or reply signal $RM_1 \ldots RM_n$ is prepared. The microprocessor 62 is intended for carrying out the following functions: processing the transmitted data, activating the transmitter 64, switching over from the receiving to the transmitting operation analysis of the received data and generating the necessary commands for the elevator control.

When the inputted story or floor call has been served by, for example, the elevator 4*b*, the user 16 enters the related cabin in order to input, in the aforedescribed or any other operating request such as, for example, a call for an emergency stop or a silent emergency call, by means of his portable transmitter-receiver unit 18 and the further stationary transmitter-receiver unit 22*d* which is integrated into the cabin panel 25. It will be assumed for the following considerations that a cabin call was inputted to the rarely demanded first story or floor 3. This rarely occurring control command, therefore, is manually inputted by actuating one or more of the keys of the ten-key or decade keyboard $Z_0 \ldots Z_g$, wherein each key designates or is associated with a respective story or floor and can be used individually or in combination with other keys. The story or floor call or the associated control signal $SS_1 \ldots SS_n$ is then manually transmitted by actuating the transmitting key 55. This control is received by the stationary transmitter-receiver unit 22*d* and fed to the elevator group control 43 substantially in the same manner as if the control signal were directly inputted at the cabin panel 25.

After arrival at the first story or floor 3, the user 16 must open the laboratory door 13 as the last step in the access check or control to the security laboratory 2. This last step can be effected, for example, in the operating mode "manually by push-button", by means of the fixed keys $F_1 \ldots F_n$ or by means of the ten-key or decade keyboard $Z_0 \ldots Z_9$ analogously to the aforedescribed opening of the security door 5.

The inventive method is of great significance in terms of improving the convenience of operation and facilitating personnel traffic, when used for operating controlled technical installations, such as doors, elevators, escalators and the like, from a desired location either from their closer neighborhood or without use of the hands. This necessity may arise, for example, in the case of a passenger who is disabled or carries a load, for instance, a mother with child and shopping bag, a businessman with newspaper and briefcase so that the passenger's freedom of movement is restricted or even greatly reduced. In such situation, the operation of the normal call keys of an elevator represents an unpleasant necessity. Starting out from the same type of hindrance, substantially the same problem is encountered when opening doors. It will be quite cumbersome to open the door to a house or an apartment.

For clarification of this possibility of use, it will be assumed that the user 16 intends to go with files 19 from the lobby 7 to an office located at a higher story or floor in the office building as shown in FIG. 1. An operating request forming a destination or target call thus is intended to be inputted without manipulation into the control 43 of the elevator group 4. For this purpose, the corresponding destination or target call is permanently stored in the storage or storage means 59 of the portable transmitter-receiver unit 18 or, as a matter of precaution, has been inputted into the portable transmitter-receiver unit 18 by the user 16 by means of the ten-key keyboard $Z_0 \ldots Z_9$ or the fixed keys $F_1 \ldots F_n$ and the operating mode "automatically, continuously" is selected or active.

The destination or target call is thus automatically transmitted every 200 milliseconds and communicated by both the stationary transmitter-receiver units 22*b* and 22*c* to the control 43 of the elevator group 4 when the user 16 is present within the corresponding effective ranges. Under such conditions, the story or floor call involving, for example, minimum service costs and, after the boarding of the user 16, also the corresponding cabin call is generated which already previously could be entered into the cost calculation. Preferably, the stationary transmitter-receiver units 22*b* and 22*c* are positioned that the time required for arriving at the elevator doors from these units, approximately corresponds to the mean waiting period after recordal of the story or floor call. There thus results a greatly reduced mean waiting period for the user and this is accomplished without adhering to a predetermined time schedule. Apparently, this leads to an increase in the carrying or conveying capacity. After boarding the elevator cabin, the user 16 reaches the requested story or floor, where the door to the desired office is opened substantially in the same manner, i.e. automatically and without manipulation.

Of course, instead of a destination or target call, a story or floor call in combination with a subsequent cabin call can also be inputted in the operating mode "automatically, continuously". Since the cabin call is continuously transmitted its input into the elevator control occurs in due time upon boarding of the elevator cabin by the user. Thus the necessity of having to actuate the keyboard in the presence of other persons is dispensed with. For use in hotels, each hotel guest may be issued a portable transmitter-receiver unit 17 or 18 at the reception. Such unit may have the size of a credit card and its function keys are programmed in respect of the public stories or floors and the story or floor associated with the room. The hotel guest is thereby guided from the lobby to his or her room. A receiving device is built into the wall in front of the room door. The room door can be opened by using a further function key. Upon loss of such card, there is merely required a change in the room identification.

Although the invention has been described hereinbefore with respect to the secure and convenient input of control commands in elevator installations and doors, the inventive method and equipment can likewise be generally used for operating controlled technical installations. Such fields of use should be obvious to any person skilled in the art with the aid and on the basis of the foregoing description.

While there are shown and described present preferred embodiments of the invention, it is to be distinctly understood that the invention is not limited thereto, but may be otherwise variously embodied and practiced within the scope of the following claims. ACCORDINGLY,

WHAT WE CLAIM IS:

1. A method of securedly and conveniently inputting control commands, particularly in elevator installations comprising at least one portable wireless transmitter-receiver unit for inputting the control commands and transmitting the control commands in the form of encoded control signals, at least one stationary transmission-receiver unit for receiving said encoded control signals, feeding decoded control signals to a control and signalling the recordation and the execution of said control commands from the control, said method including the steps of:

selectively allocating the control commands, as a function of their frequency of occurrence, to either ones of the following different groups of control commands, namely (i) rarely occurring control commands, (ii) more frequently occurring control commands, and (iii) very frequently occurring control commands;

individually inputting said rarely occurring control commands as well as said more frequently occurring control commands at said at least one portable transmitter-receiver unit by means of a ten-key keyboard and fixed keys, respectively;

permanently storing said very frequently occurring control commands at storage means of said at least one portable transmitter-receiver unit;

converting said inputted or stored control commands at said at least one portable transmitter-receiver unit into respective control signals each one of which comprises a security-related control signal portion and a function-related control signal portion;

selectively transmitting each said control signal by said at least one portable transmission-receiver unit in either one of (i) a "manually by push-button" transmitting mode or (ii) an "automatically, continuously" transmitting mode;

automatically switching over said at least one portable transmitter-receiver unit after each transmitting operation to reception for a predetermined period of time;

receiving said control signal transmitted by said at least one portable transmitter-receiver unit, by at least one stationary transmitter-receiver unit;

analyzing said received control signal by said at least one stationary transmitter-receiver unit with respect to said security-related control signal portion and said function-related control signal portion;

in the event of a negative result of the security-related analyzing operation, ignoring said received control signal in said at least one stationary transmitter-receiver unit;

in the event of a positive result of the security-related analyzing operation, feeding the received control signal from said at least one stationary transmitter-receiver unit to a control;

transmitting a first response signal from said at least one stationary transmitter-receiver unit for signalling recordation of said control command at an indicator of said at least one portable transmitter-receiver unit and thereby blocking said at least one portable transmitter-receiver unit for further control command output; and transmitting, after execution of said control command, a second response signal from said at least one stationary transmitter-receiver unit for erasing the indication at said at least one portable transmitter-receiver unit and thereby releasing said at least one portable transmitter-receiver unit for further control command output.

2. The method as defined in claim 1, wherein:

said step of allocating said more frequently occurring control commands to respective ones of said fixed keys entails simultaneously actuating a memory key at said at least one portable transmitter-receiver unit.

3. The method as defined in claim 1, wherein:

said steps of transmitting said control signal and said response signal between said at least one portable transmitter-receiver unit and said at least one stationary transmitter-receiver unit, entails wireless transmitting digitally encoded infrared signals as said control signals and said response signals.

4. The method as defined in claim 1, wherein:

said step of converting said inputted or stored control commands into said control signal entails incorporating into said security-related control signal portion an identifier control signal portion for selectively identifying either one of (i) a user, (ii) a control or (iii) a building.

5. The method as defined in claim 1, wherein:

said step of transmitting said control signals in either one of said two transmitting modes, entails preferentially transmitting control signals related to inputted control commands with respect to control signals related to stored control commands.

6. The method as defined in claim 1, wherein:

substantially simultaneously carrying out said receiving and transmitting functions at said at least one stationary transmitter-receiver unit in order to thereby increase the data transmission rate.

7. Equipment for securedly and conveniently inputting control commands, particularly in an elevator installation, comprising:

at least one portable transmitter-receiver unit for transmitting control signals and receiving response signals;

said at least one portable transmitter-receiver unit containing:

a microprocessor;

a ten-key keyboard for inputting rarely occurring control commands;

a predetermined number of fixed keys for inputting more frequently occurring control commands;

storage means for permanently storing very frequently occurring control commands;

a wireless transmitter containing an operating mode selector switch for switching between a "automatically, continuously" transmitting mode and a "manually by push-button" transmitting mode;

said keyboard, said fixed keys, said storage means and said transmitter being connected to said microprocessor;

said microprocessor processing said inputted or stored control commands and thereby converting the control commands into control signals to be transmitted by said transmitter;

a transmitter key for operating said transmitter in a selected one of said transmitting modes for transmitting said control signals;

a receiver connected to said microprocessor; and indicator means connected to said microprocessor;

at least one stationary transmitter-receiver unit for receiving said control signals transmitted by said at least one portable transmitter-receiver unit and for transmitting response signals to be received by said receiver of said at least one portable transmitter-receiver unit;

said at least one stationary transmitter-receiver unit containing:

a receiver for receiving said control signals transmitted by said at least one portable transmitter-receiver unit;

a transmitter for transmitting response signals; and a microprocessor connected to said receiver for analyzing said received control signals with respect to security;

a control connected to said at least one stationary transmitter-receiver unit for executing the control commands related to said control signals received by said receiver of said at least one stationary transmitter-receiver unit;

said control being connected to said microprocessor of said at least one stationary transmitter-receiver unit for generating response signals indicative of the control status of said control;

said transmitter of said at least one stationary transmitter-receiver unit transmitting said response signals;

said receiver of said at least one portable transmitter-receiver unit receiving said response signals transmitted by said transmitter of said at least one stationary transmitter-receiver unit; and said indicator of said at least one portable transmitter-receiver unit indicating recordation of said control command at said control upon receipt of said response signals at said receiver of said at least one portable transmitter-receiver unit.

* * * * *